US008499869B2

(12) United States Patent
Cimatti et al.

(10) Patent No.: US 8,499,869 B2
(45) Date of Patent: Aug. 6, 2013

(54) COOLING SYSTEM FOR A VEHICLE WITH HYBRID PROPULSION

(75) Inventors: Franco Cimatti, Pavullo (IT); Fabrizio Favaretto, Formigine (IT)

(73) Assignee: Ferrari S.p.A. (IT)

( * ) Notice: Subject to any disclaimer, the term of this patent is extended or adjusted under 35 U.S.C. 154(b) by 253 days.

(21) Appl. No.: 13/006,213

(22) Filed: Jan. 13, 2011

(65) Prior Publication Data

US 2012/0018118 A1 Jan. 26, 2012

(30) Foreign Application Priority Data

Jan. 13, 2010 (IT) ..... BO2010A0012

(51) Int. Cl.
*B60H 1/00* (2006.01)

(52) U.S. Cl.
USPC ..... 180/68.1; 180/68.4; 165/41

(58) Field of Classification Search
USPC ..... 180/68.1, 68.2, 68.4, 68.6; 165/41, 165/101
See application file for complete search history.

(56) References Cited

U.S. PATENT DOCUMENTS 5,353,757 A 10/1994 Susa et al.
5,884,697 A * 3/1999 Pierron et al. ..... 165/203
7,284,594 B2 * 10/2007 Sanada et al. ..... 165/41
7,322,399 B2 * 1/2008 Guerrero et al. ..... 165/101
2002/0073726 A1 6/2002 Hasebe et al.
2004/0206474 A1 * 10/2004 Watanabe et al. ..... 165/51
2005/0274507 A1 12/2005 Sanada et al.
2010/0116458 A1 * 5/2010 Kim ..... 165/41
2010/0147611 A1 * 6/2010 Amano et al. ..... 180/68.1

FOREIGN PATENT DOCUMENTS

FR 2844041 A1 3/2004
WO WO-2004/020927 A1 3/2004

OTHER PUBLICATIONS

"Italian Application Serial No. IT B020100012, Search Report dated Nov. 20, 2010", 2 pgs.

* cited by examiner

*Primary Examiner* — John Walters
*Assistant Examiner* — Brian Swenson
(74) *Attorney, Agent, or Firm* — Schwegman Lundberg & Woessner, P.A.; Matt Prater

(57) ABSTRACT

A cooling system for a vehicle with hybrid propulsion, the cooling system including a hydraulic circuit, within which a refrigerant flows, with a main branch to cool of a thermal engine, and a secondary branch to cool electrical components and at least one common radiator, which comprises a first portion, that is normally used by the main branch of the hydraulic circuit and has at least two trays arranged at the ends, and a second portion that is normally used by the secondary branch of the hydraulic circuit and has at least two trays arranged at the ends.

18 Claims, 5 Drawing Sheets

COOLING SYSTEM FOR A VEHICLE WITH HYBRID PROPULSION

PRIORITY CLAIM

This application claims the benefit of priority under 35 U.S.C. Section 119 to Italian Patent Application Serial No. B02010A 000012, filed on Jan. 13, 2010, which is incorporated herein by reference in its entirety.

TECHNICAL FIELD

The present invention relates to a cooling system for a vehicle with hybrid propulsion.

BACKGROUND

A hybrid vehicle comprises an internal combustion thermal engine, which transmits torque to the driving wheels by means of a transmission provided with a gearbox, and at least one electric machine, which is electrically supplied by an electronic power converter mechanically connected to the driving wheels. The electric machine is driven by an electric drive connected to an electric storage system typically consisting of a pack of chemical batteries, possibly connected in parallel to one or more supercapacitors.

A conventional vehicle comprises a thermal engine cooling system, which uses a cooling liquid (typically water mixed with antifreeze substances) which is circulated through the thermal engine and through a water-air radiator which is invested or influenced by the air when the vehicle is moving.

In a hybrid vehicle, a cooling system dedicated to the electric components, i.e. to the electric machine, the electronic power converter and the storage system, is also used or required to avoid the electric components from overheating. With this regard, it is worth noting that, in use, all electric components are sources of electrical energy loss, which is transformed into heat and is to be appropriately disposed of. As in the thermal engine cooling system, the electric component cooling system also uses a cooling liquid (typically water mixed with antifreeze substances), which is circulated through the electric components and through a water-air radiator which is invested or influenced by the air when the vehicle is moving. The two cooling liquids of the two systems (i.e. the cooling liquid of the thermal engine cooling system and the cooling liquid of the electric component cooling system) are kept separate, because the cooling liquid circulating through the thermal engine reaches, at full rate, a temperature of 100°-110° C., while the cooling liquid circulating through the electric components should not exceed, at full rate, a temperature of 65°-85° C.

In order to keep the two cooling liquids separate in the known hybrid vehicles, two independent radiators are provided, arranged side-by-side (typically overlapped so that the radiator of the electric component cooling system is invested or influenced by the air first). In so doing, however, the radiator of the electric component cooling system may not be effectively and efficiently used for cooling the thermal engine when the electric components are not used (e.g. when running on a highway).

Patent application WO2004020927A1 describes a cooling circuit of a vehicle provided with a main high-temperature branch which cools the thermal engine and with a secondary low-temperature branch which cools the vehicle equipment; the two branches share the same radiator which has a central portion which may be alternatively used by the branches acting on corresponding hydraulic valves.

SUMMARY

Some examples provide a cooling system for a vehicle with hybrid propulsion, which is free from the above-described drawbacks while being easy and cost-effective to be manufactured.

According to some examples, a cooling system for a vehicle with hybrid propulsion is provided as claimed in the attached claims.

BRIEF DESCRIPTION OF THE DRAWINGS

The present invention will now be described with reference to the accompanying drawings, which illustrate some non-limitative embodiments thereof, in which.

DETAILED DESCRIPTION

Figure 1:
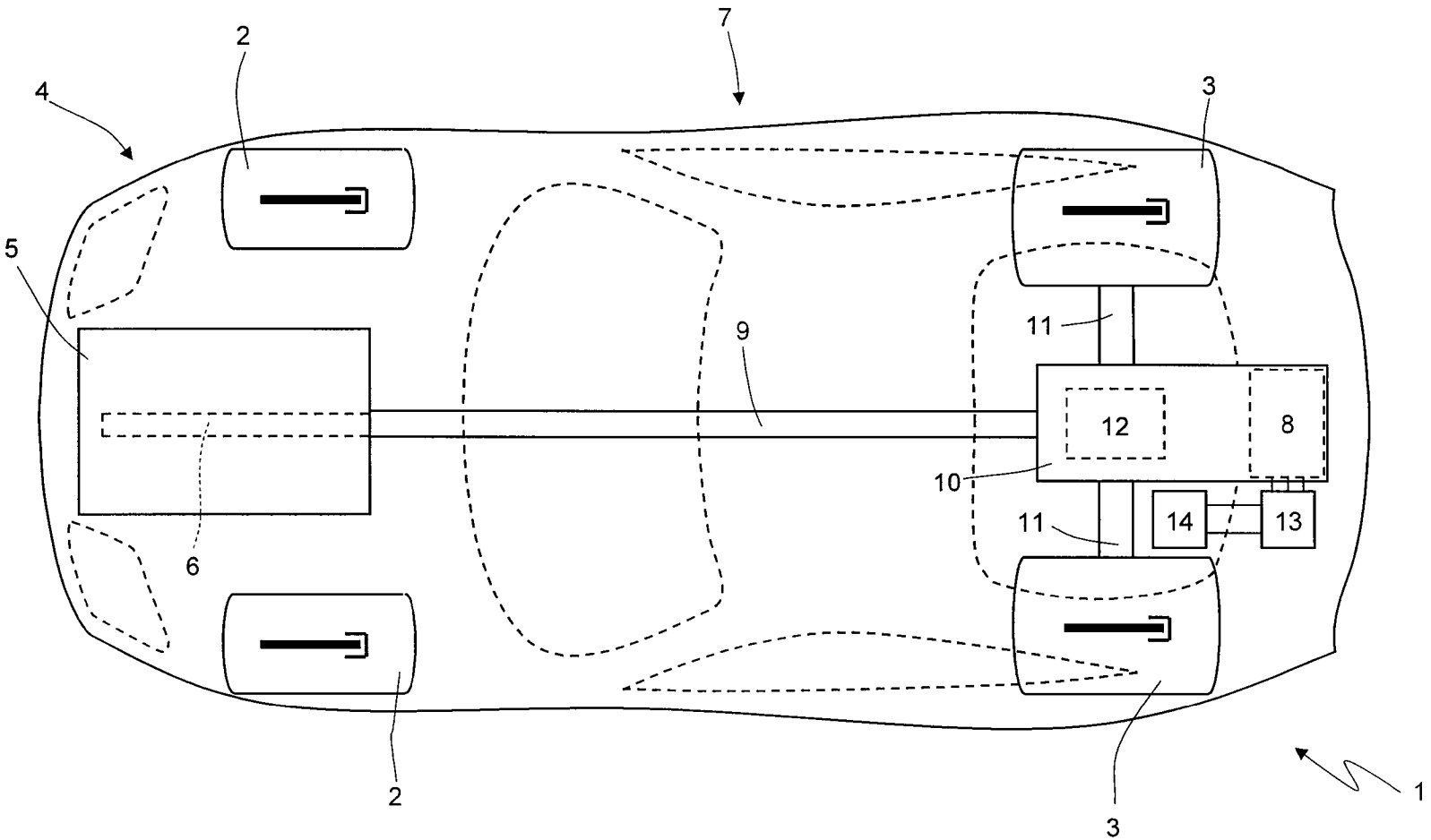
FIG. 1 is a diagrammatic plan view, with parts removed for clarity, of a hybrid vehicle provided with a cooling system made according to some examples.

In FIG. 1, numeral 1 indicates as a whole a vehicle with hybrid propulsion provided with two front wheels 2 and with two rear driving wheels 3, which receive torque from a hybrid propulsion system 4.

The hybrid propulsion system 4 comprises an internal combustion thermal engine 5, which is arranged in front position, and is provided with a motor shaft 6, a servo-controlled transmission 7 which transmits the torque generated by the internal combustion thermal engine 5 to the rear driving wheels 3, and a reversible electric machine 8 (i.e. which may work either as an electric motor by absorbing electrical energy and generating mechanical torque, or as an electric generator by absorbing mechanical energy and generating electrical energy), which is mechanically connected to the servo-controlled transmission 7.

The servo-controlled transmission 7 comprises a propeller shaft 9, which is angularly integral with the motor shaft 6 on one side, and is mechanically connected to a gearbox 10 on the other side, which is arranged in a rear position and transmits motion to the rear driving wheels 3 by means of two axle shafts 11, which receive motion from a differential 12. The reversible electric machine 8 is mechanically connected to the gearbox 10 and driven by an electronic power converter 13 connected to a storage system 14, which is adapted to store electrical energy and comprises a series of storage devices 15 (shown in detail in FIGS. 3 and 4) including chemical batteries and/or supercapacitors.

Figure 2:
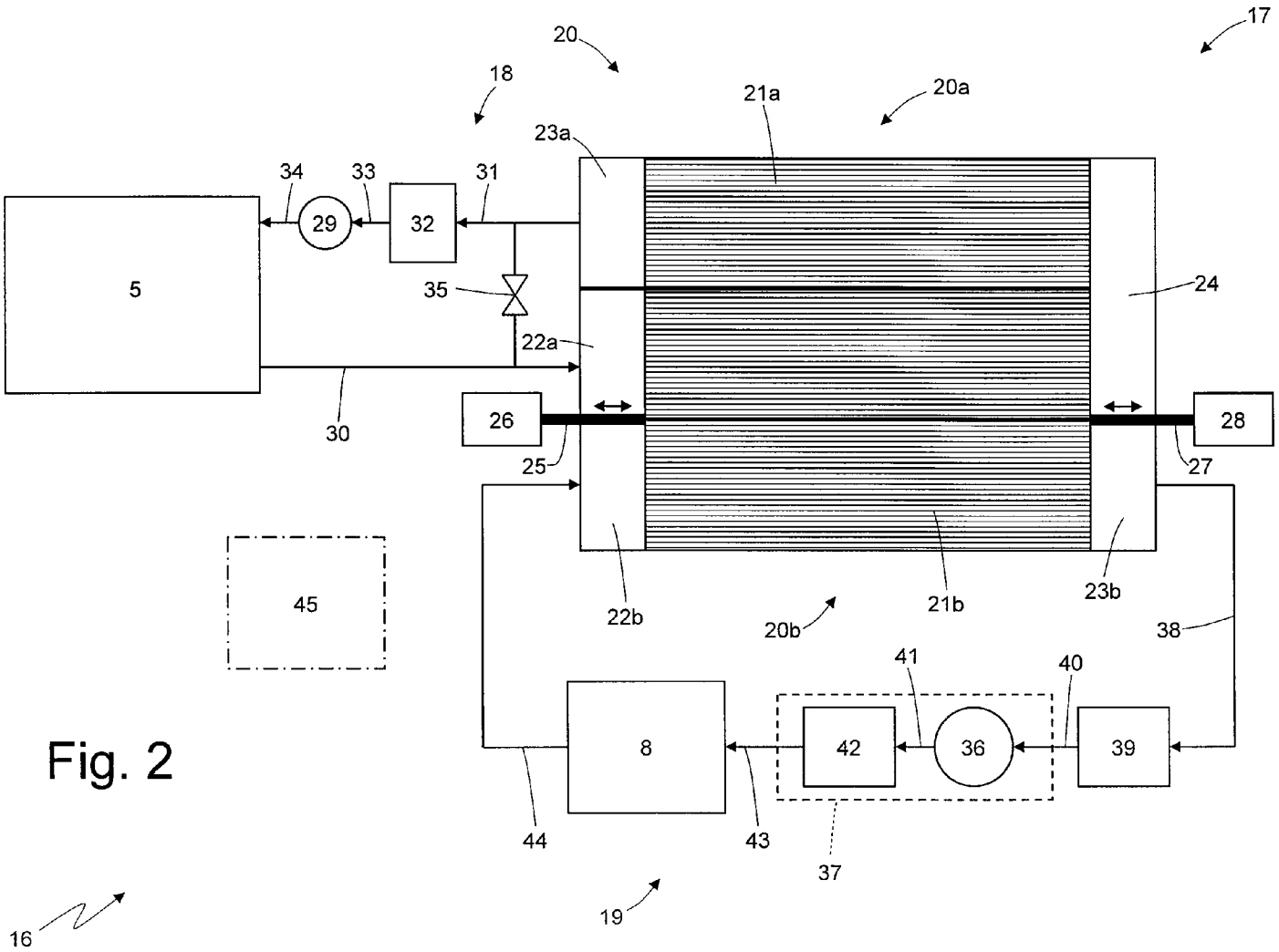
FIG. 2 is a diagrammatic view of the cooling system of the vehicle in FIG. 1.

As shown in FIG. 2, vehicle 1 comprises a cooling system 16, which has the task of cooling the thermal engine 5, the gearbox 10 and the electric components (i.e. electric machine 8, electronic power converter 13, and storage system 14).

The cooling system 16 comprises a hydraulic circuit 17 in which a refrigerant flows, which typically includes water mixed with an antifreeze additive. The hydraulic circuit 17 comprises a main branch 18, which is entirely located in front position and cools the thermal engine 5, and a secondary branch which is partially located in rear position and cools the electric components (i.e. electric machine 8, electronic power converter 13 and storage system 14).

The cooling system 16 comprises a single radiator 20 (i.e. a heat exchanger 20 of the water/air type), which is arranged in the frontal position to be invested or influenced by air when vehicle 1 is moving, the single radiator in common with both branches 18 and 19 of the hydraulic circuit 17. According to a different embodiment (not shown), two twin radiators 20 are provided, which are connected to each other either in series or in parallel. Radiator 20 comprises a larger portion 20*a* (as it should dispose of more heat), which is normally used by the main branch 18 of the hydraulic circuit 17 and is "U"-shaped (thus the inlet and outlet are arranged on the same side), and a smaller portion 20*b* (as it should dispose of a lesser amount of heat), which is normally used by the secondary branch 19 of the hydraulic circuit 17 and has a rectilinear shape (thus the inlet and outlet are arranged on opposite sides). According to a different embodiment (not shown), portion 20*a* of radiator 20 also has a rectilinear shape (thus the inlet and outlet are arranged on opposite sides). According to a further embodiment (not shown), portion 20*a* of radiator 20 shows a more complex shape than the "U" shape; for example, portion 20*a* of radiator 20 is "S"-shaped (where the inlet and outlet are arranged on opposite sides).

Radiator 20 comprises a pack 21 of coils which is concerned or influenced by the air flow to carry out the thermal exchange and which is divided into a pack 21*a* of coils belonging to portion 20*a* and a pack of coils 21*b* belonging to portion 20*b*. Radiator 20 comprises an input tray 22*a* (or input manifold 22*a*), which is arranged at one end of radiator 20 and feeds the refrigerant to the pack 21*a* of coils, an output tray 23*a* (or output manifold 23*a*), which is arranged at one end of radiator 20 and receives the refrigerant from the pack 21*a* of coils, and an intermediate tray 24 (or intermediate manifold 24), which is arranged at one end of radiator 20 and makes the refrigerant perform a "U" turn. Similarly, radiator 20 comprises an input tray 22*b* (or input manifold 22*b*), which is arranged at one end of radiator 20, feeds the refrigerant to the pack 21*b* of coils and is arranged by the side of the input tray 22*a*, and an output tray 23*b* (or output manifold 23*b*), which is arranged at one end of radiator 20, receives refrigerant from the pack 21*b* of coils and is arranged by the side the intermediate tray 24.

The input tray 22*a* is divided from the input tray 22*b* by a first partition 25, which is movable between a closed position (shown in FIGS. 2 and 4), in which it determines a sealed isolation between the input tray 22*a* and the input tray 22*b*, and an open position (shown in FIGS. 3 and 5), in which it puts input tray 22*a* into communication with input tray 22*b*. Partition 25 is connected to an actuator device 26 (typically electrically actuated by means of an electric motor or electromagnet) which moves partition 25 with a translation movement between the closed position and the open position. Similarly, the intermediate tray 24 is divided from the output tray 23*b* by a partition 27, which is movable between a closed position (shown in FIGS. 2 and 4), in which it determines a sealed isolation between the intermediate tray 24 and the output tray 23*b*, and an open position (shown in FIGS. 3 and 5), in which it puts the intermediate tray 24 into communication with the output tray 23. Partition 27 is connected to an actuator device 28 (typically electrically actuated by means of an electric motor or electromagnet), which moves partition 27 with a translation movement between the closed position and the open position.

The main branch 18 comprises a mechanically actuated circulation pump 29, which determines the circulation of refrigerant along the main branch 18 and is directly actuated by the motor shaft 6 of thermal engine 5. Furthermore, the main branch 18 comprises a pipe 30, which connects an outlet of a cooling labyrinth of the engine block of thermal engine 5 to the input tray 22*a* of portion 20*a* of radiator 20, a pipe 31 which connects the output tray 23*a* of portion 20*a* of radiator 20 to an inlet of a heat exchanger 32 of the water/oil type, which cools the lubrication oil of thermal engine 5, a pipe 33 which connects an outlet of the heat exchanger 32 to an inlet of the circulation pump 29, and a pipe 34 which connects an outlet of the circulation pump 29 to an inlet of the cooling labyrinth of the engine block of thermal engine 5.

According to some examples, the main branch 18 comprises a bypass valve 35, which puts the pipes 30 and 31 into communication and is electronically driven (alternatively, the bypass circulation valve 35 could be thermostatic). When the bypass valve 35 is closed, the refrigerant flows through the radiator 20, while when the bypass valve 35 is open, the refrigerant flows through the bypass valve 35 and does not cross radiator 20. The bypass valve 35 is driven according to the temperature of the refrigerant, which is measured by a temperature sensor (known and not shown) arranged along the main branch 18 of the hydraulic circuit 17. When the temperature of the refrigerant is below a minimum threshold value (i.e. when thermal engine 5 is "cold"), the bypass valve 35 is opened to avoid the refrigerant from crossing radiator 20 and thus to hold the heat produced within thermal engine 5 as much as possible, so as to accelerate the heating of the thermal engine 5 itself; instead, when the temperature of the refrigerant is above the minimum threshold value (i.e. when thermal engine 5 is "hot"), the bypass valve 35 is closed to circulate the refrigerant through radiator 20, so as to allow the heat produced by thermal engine 5 to disperse into the external environment.

The secondary branch 19 comprises an electrically actuated circulation pump 36, which determines the circulation of the refrigerant along the secondary branch 19 and, according to some examples, is integrated with the electronic power converter 13 to form a single unit enclosed in a common container 37. Moreover, the secondary branch 19 comprises a pipe 38 which connects the output tray 23*b* of position 20*b* of radiator 20 to an inlet of a heat exchanger 39 of the storage system 14, a pipe 40 which connects an outlet of the heat exchanger 39 to an inlet of the circulation pump 36, a pipe 41 which connects an outlet of the circulation pump 36 to an inlet of a heat exchanger 42 of the electronic power converter 13, a pipe 43 which connects an outlet of the heat exchanger 42 to an inlet of a cooling labyrinth of the electric machine 8, and a pipe 44 which connects an outlet of the cooling labyrinth of the electric machine 8 to the input tray 22*b* of portion 20*b* of radiator 20.

Further constructional details of the heat exchanger 39 of storage system 14 and of the heat exchanger 42 of electronic power converter 13 are provided in patent application IT2009BO00181 which is incorporated herein by reference in its entirety.

Finally, the cooling system 16 comprises a control unit 45, which superintends the operation of the cooling system 16 and, in particular, drives the actuators 26 and 28 to determine the position of partitions 25 and 27 according to the control logic described below.

Figure 3:
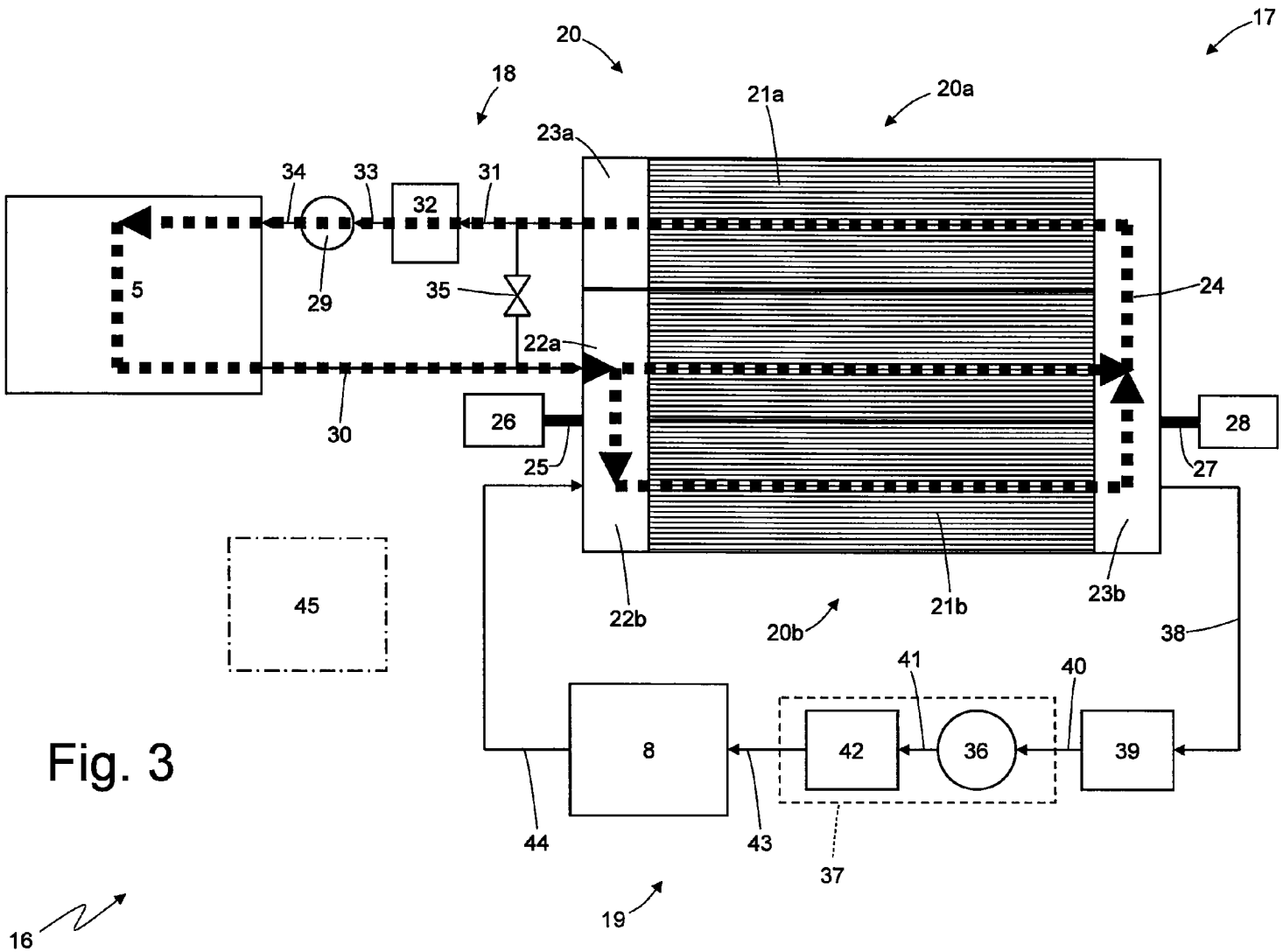
FIGS. 3, 4 and 5 are three diagrammatic views of the cooling system in FIG. 2 showing the circulation paths of a refrigerant in three different operating modes.

With reference to FIG. 3, when thermal engine 5 is on and circulation pump 36 is off, i.e. when the electric components do not use or require cooling (typically when electric machine 8 is off), partitions 25 and 27 may be opened (i.e. may be arranged in the open position) to allow the main branch 18 of the hydraulic circuit 17 to use, in addition to the portion 20*a*, also the portion 20*b* of radiator 20. When partitions 25 and 27 are open, the input tray 22*a* communicates with the input tray 22*b*, and the intermediate tray 24 communicates with the output tray 23*b*; the refrigerant from thermal engine 5 through pipe 30 thus crosses both portions 20*a* and 20*b* of radiator 20 and is finally conveyed into the output tray 23*a* to proceed through pipe 31. In this circumstance, the refrigerant circulating through the main branch 18 does not cross, unless only marginally and greatly negligibly, the secondary branch 19, because when the circulation pump 36 is off, the circulation pump 36 itself offers a considerable resistance to the refrigerant passing; therefore, until the circulation pump 36 is off, the refrigerant in the secondary branch 19 remains stationary and is not subject, unless marginally, to mixing with the refrigerant present in the main branch 18. In other words, when the circulation pump 36 is off, the circulation of the refrigerant through the secondary branch 19 is very limited, because the refrigerant pushed by the circulation pump 29 encounters a much lower hydraulic resistance when flowing through the portion 20*b* of radiator 20 (which is arranged in parallel to the secondary branch 19) rather than through the secondary branch 19.

Figure 4:
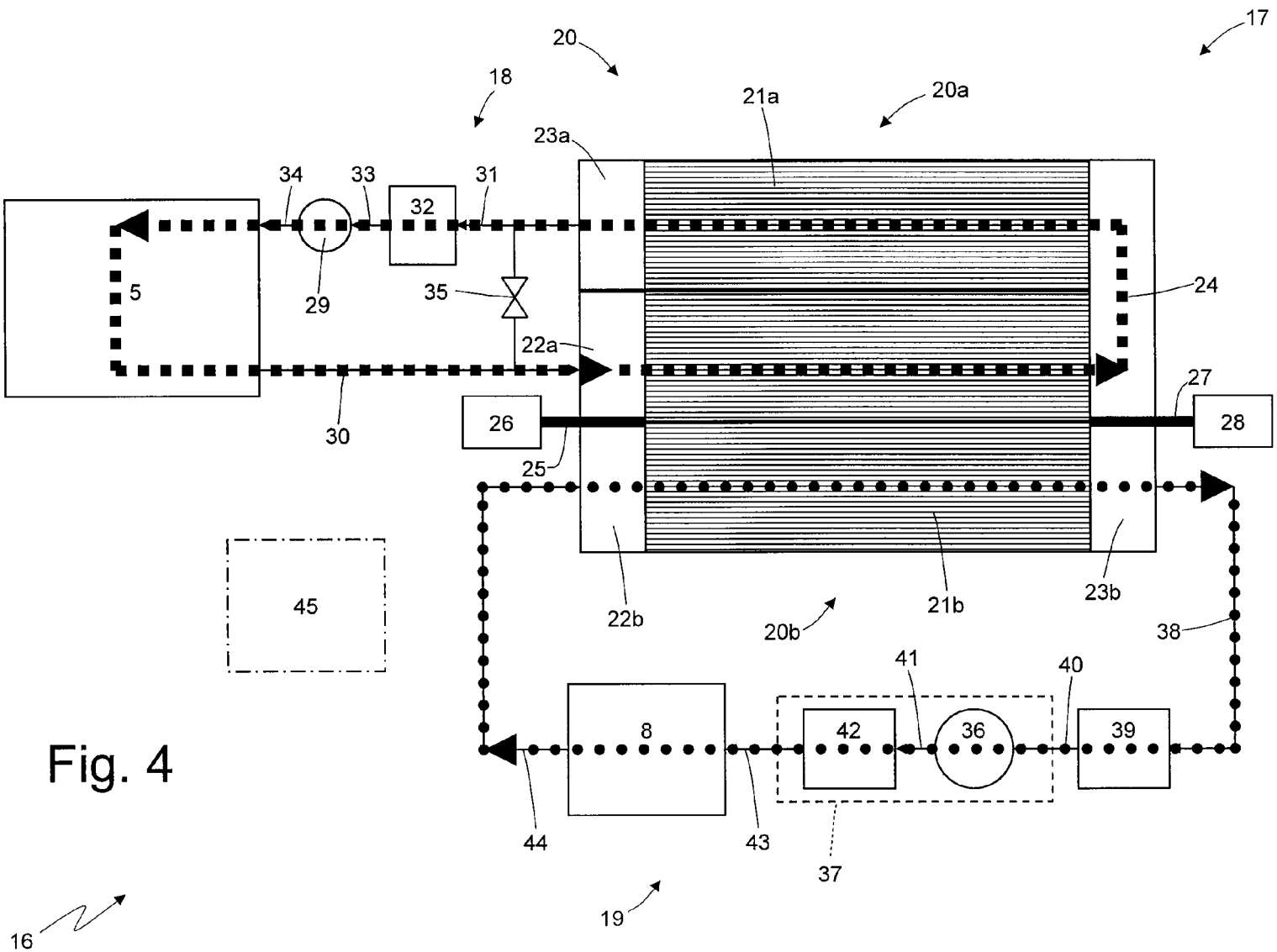

With reference to FIG. 4, when thermal engine 5 is on and the circulation pump 36 is on, i.e. when the electric components use or require cooling (typically when the electric machine 8 is running), partitions 25 and 27 should be normally closed (i.e. should arranged in the closed position) to separate the two branches 18 and 19 of the hydraulic circuit 17 (i.e. so that the refrigerant of the primary branch 18 uses only the portion 20*a* of radiator 20 and the refrigerant of the secondary branch 19 uses only the portion 20*b* of radiator 20). In this circumstance, the two branches 18 and 19 of the hydraulic circuit 17 are completely separate, and therefore the temperatures of the cooling liquids of the two branches 18 and 19 of the hydraulic circuit 17 may be different to adapt to the different thermal needs of thermal engine 5 and electric components. It is worth noting that when thermal engine 5 is on and "cold" and the circulation pump 36 is on, partitions 25 and 27 could be temporarily kept open so as to promote a mixing of the cooling liquids of the two branches 18 and 19 of the hydraulic circuit 17 in order to use a part of the heat produced by the electric components to heat thermal engine 5.

Figure 5:
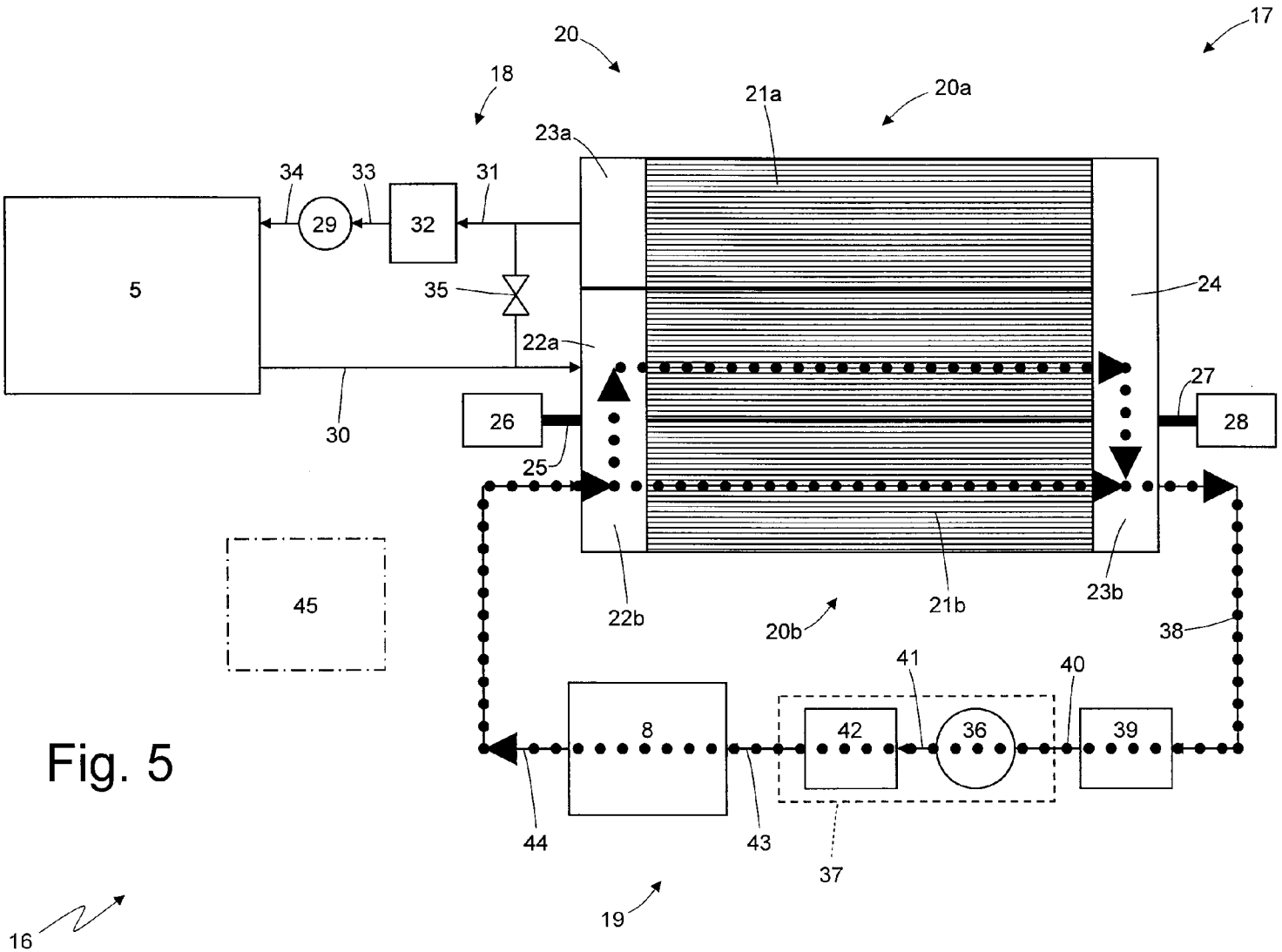

With reference to FIG. 5, when thermal engine 5 is off (thus stationary) and the circulation pump 36 is on, i.e. when the electric components use or require cooling (typically when the electric machine 8 is running), partitions 25 and 27 may be opened (i.e. may be arranged in the open position) to allow the secondary branch 19 of the hydraulic circuit 17 to use, in addition to portion 20*b*, also a part of the portion 20*a* of radiator 20. When partitions 25 and 27 are open, the input tray 22*a* communicates with the input tray 22*b* and the intermediate tray 24 communicates with the output tray 23*b*; the refrigerant from the electric components through pipe 44 thus crosses both portions 20*a* and 20*b* of radiator 20 and is finally conveyed into the output tray 23*b* to proceed through pipe 38. In this circumstance, the refrigerant circulating through the secondary branch 19 does not cross, unless only marginally and greatly negligibly, the main branch 18, because when the circulation pump 29 is off, the circulation pump 29 itself offers a considerable resistance to the refrigerant passing; therefore, until the circulation pump 29 is off, the refrigerant in the main branch 18 remains stationary and is not subject, unless marginally, to mixing with the refrigerant present in the secondary branch 19. In other words, when the circulation pump 36 is off, the circulation of the refrigerant through the main branch 18 is very limited, because the refrigerant pushed by the circulation pump 36 encounters a much lower hydraulic resistance when flowing through the portion 20*a* of radiator 20 (which is arranged in parallel to the main branch 18) rather than through the main branch 18.

According to a different embodiment (not shown), an on-off valve may be arranged along the secondary branch 19, which is electronically driven to cut off the secondary branch 19 when it is intended to circulate the refrigerant through the secondary branch 19 itself.

In brief, when both branches 18 and 19 of the hydraulic circuit 17 are used (i.e. when both the thermal engine 5 and the electric components use or require cooling), partitions 25 and 27 are closed so that the two branches 18 and 19 of the hydraulic circuit 17 are reciprocally isolated and exclusively use the respective portions 20*a* and 20*b* of radiator 20. Thereby, the temperatures of the cooling liquids in the two branches 18 and 19 of the hydraulic circuit 17 may be different to adapt to the different thermal needs of thermal engine 5 and electric components. When, instead, one branch 18 or 19 of the hydraulic circuit 17 is not used, the other branch 19 or 18 of the hydraulic circuit 17 may exclusively use all the radiator 20 (i.e. both portions 20*a* and 20*b*) by simply opening the partitions 25 and 27; partitions 25 and 27 are obviously opened only if the branch 18 or 19 of the hydraulic circuit 17 currently in use uses or requires a high cooling power.

When thermal engine 5 is at full power (thus uses or requires a high cooling capacity), the electric machine 8 is generally off and vice versa; i.e. it never occurs that both the thermal engine 5 and the electric machine 8 work together at full power (also because in a similar operating mode the gearbox 10 would be overstressed, i.e. would be used or required to transmit a torque higher than its failure limits). Therefore, when thermal engine 5 is at full power (thus uses or requires a high cooling capacity), the main branch 18 may use both portions 20*a* and 20*b* of radiator 20 and when the electric machine 8 is at full power, the secondary branch 19 may use both portions 20*a* and 20*b* of radiator 20. From this, the portion 20*a* of radiator 20 results to be under-dimensioned as compared to the maximum cooling power used or required by the thermal engine 5, because when thermal engine 5 is at full power (thus uses or requires a high cooling capacity), the main branch 18 may use both portions 20*a* and 20*b* of radiator 20. Similarly, portion 20*b* of radiator 20 may also be under-dimensioned as compared to the maximum cooling power used or required by the electric components, because when the electric machine 8 is at full power (thus uses or requires a high cooling capacity), the secondary branch 19 may use both portions 20*a* and 20*b* of radiator 20.

The above-described cooling system 16 has many advantages.

Firstly, the cooling system 16 has a single radiator 20, which is intelligently shared by both branches 18 and 19 of the hydraulic circuit 17; thereby, the overall size of radiator 20 is minimized and the arrangement of radiator 20 in vehicle 1 is simplified.

Furthermore, the two branches 18 and 19 of the hydraulic circuit 17 may be separated, so that the temperatures of the cooling liquids of the two branches 18 and 19 of the hydraulic circuit 17 may be different to adapt to the different thermal needs of thermal engine 5 and electric components.

What is claimed is:

1. A cooling system for a vehicle with hybrid propulsion, the cooling system comprising:

a hydraulic circuit configured to flow a refrigerants, and comprising a main branch configured to cool a thermal engine, and a secondary branch configured to cool electrical components; and at least one common radiator comprising a first portion in communication with the main branch of the hydraulic circuit, the first portion comprising at least two first portion trays arranged at first portion ends, the at least one common radiator comprising a second portion in communication with the secondary branch of the hydraulic circuit, the second portion comprising at least two trays arranged at second portion ends;

a first circulation pump in communication with the main branch and configured to be mechanically driven to flow the refrigerant through the main branch and to be operated directly by a motor shaft of the thermal engine;

a second circulation pump in communication with the secondary branch and configured to be electrically driven to flow the refrigerant through the secondary branch;

a first movable partition configured to alternatively place a first tray of the first portion in communication with a second tray of the second portion and to isolate the first tray of the first portion from communication with the second tray of the second portion;

a second movable partition configured to alternatively place a third tray of the first portion in communication with a fourth tray of the second portion and to isolate the third tray of the first portion from communication with the fourth tray of the second portion; and a control unit configured to drive one or both of the first movable partition and the second movable partition to maintain the first tray of the first portion isolated from communication with the second tray of the second portion and to maintain the third tray of the first portion isolated from communication from the fourth tray of the second portion when the thermal engine is active and the second circulation pump is running.

2. A cooling system according to claim 1, wherein the control unit is configured to maintain the first tray of the first portion in communication with the second tray of the second portion and to maintain the third tray of the first portion in communication with the fourth tray of the second portion when the thermal engine is on and the second circulation pump is off.

3. A cooling system according to claim 1, wherein the control unit is configured to maintain the first tray of the first portion in communication with the second tray of the second portion and to maintain the third tray of the first portion in communication with the fourth tray of the second portion when the thermal engine is off and the second circulation pump is running.

4. A cooling system according to claim 1, wherein the first portion and the second portion of the radiator are arranged alongside one another so that the first tray of the first portion is adjacent to the second tray of the second portion and the third tray of the first portion is adjacent to the fourth tray of the second portion.

5. A cooling system according to claim 4, comprising:

a first actuating device configured to move the first movable partition between an open position, in which the first tray of the first portion is in communication with the second tray of the second portion, and a closed position, in which the first tray of the first portion is isolated from the second tray of the second portion; and a second actuating device configured to move the second movable partition between an open position, in which the third tray of the first portion is in communication with the fourth tray of the second portion, and a closed position, in which the third tray of the first portion is isolated from the fourth tray of the second portion.

6. A cooling system according to claim 1, wherein:

the first portion of the radiator has a rectilinear shape;

the first tray of the first portion is an input tray configured to receive the refrigerant directed toward the first portion of the radiator; and the third tray of the first portion is an output tray configured to receive the refrigerant leaving the first portion of the radiator.

7. A cooling system according to claim 1, wherein:

the first portion of the radiator has at least a "U" shape;

the first tray of the first portion is an input tray configured to receive the refrigerant directed toward the first portion of the radiator; and the third tray of the first portion is an intermediate tray.

8. A cooling system according to claim 1, wherein:

the second portion of the radiator has a rectilinear shape;

the second tray of the second portion is an input tray configured to receive the refrigerant directed toward the second portion of the radiator; and the fourth tray of the second portion is an output tray configured to receive the refrigerant leaving the second portion of the radiator.

9. A cooling system according to claim 1, wherein the electrical components comprise an electric machine, a power electronic converter configured to drive the electric machine, and a system configured to store electrical energy, the system connected to the power electronic converter.

10. A cooling system for a vehicle with hybrid propulsion, the cooling system comprising:

a hydraulic circuit configured to flow a refrigerants, and comprising a main branch configured to cool a thermal engine, and a secondary branch configured to cool electrical components; and at least one common radiator comprising a first portion in communication with the main branch of the hydraulic circuit, the first portion comprising at least two first portion trays arranged at first portion ends, the at least one common radiator comprising a second portion in communication with the secondary branch of the hydraulic circuit, the second portion comprising at least two trays arranged at second portion ends;

a first circulation pump in communication with the main branch and configured to be mechanically driven to flow the refrigerant through the main branch and to be operated directly by a motor shaft of the thermal engine;

a second circulation pump in communication with the secondary branch and configured to be electrically driven to flow the refrigerant through the secondary branch;

a first means of connection for alternatively placing a first tray of the first portion in communication with a second tray of the second portion and for isolating the first tray of the first portion from communication with the second tray of the second portion;

a second means of connection for alternatively placing a third tray of the first portion in communication with a fourth tray of the second portion and for isolating the third tray of the first portion from communication with the fourth tray of the second portion; and a control unit configured to drive one or both of the first means and the second means to maintain the first tray of the first portion isolated from communication with the second tray of the second portion and to maintain the third tray of the first portion isolated from communication from the fourth tray of the second portion when the thermal engine is active and the second circulation pump is running.

11. A cooling system according to claim 10 wherein the control unit is configured to maintain the first tray of the first portion in communication with the second tray of the second portion and to maintain the third tray of the first portion in communication with the fourth tray of the second portion when the thermal engine is on and the second circulation pump is off.

12. A cooling system according to claim 10 wherein the control unit is configured to maintain the first tray of the first portion in communication with the second tray of the second portion and to maintain the third tray of the first portion in communication with the fourth tray of the second portion when the thermal engine is off and the second circulation pump is running.

13. A cooling system according to claim 10 wherein the first portion and the second portion of the radiator are arranged alongside one another so that the first tray of the first portion is adjacent to the second tray of the second portion and the third tray of the first portion is adjacent to the fourth tray of the second portion.

14. A cooling system according to claim 13 wherein:

the first means of connection comprises a first movable partition configured to separate the first tray of the first portion from the second tray of the second portion; and a first actuating device configured to move the first movable partition between an open position, in which the first tray of the first portion is in communication with the second tray of the second portion, and a closed position, in which the first tray of the first portion is isolated from the second tray of the second portion; and the second means of connection comprises a second movable partition configured to separate the third tray of the first portion from the fourth tray of the second portion; and a second actuating device configured to move second movable partition between an open position, in which the third tray of the first portion is in communication with the fourth tray of the second portion, and a closed position, in which the third tray of the first portion is isolated from the fourth tray of the second portion.

15. A cooling system according to claim 10 wherein:

the first portion of the radiator has a rectilinear shape;

the first tray of the first portion is an input tray configured to receive the refrigerant directed toward the first portion of the radiator; and the third tray of the first portion is an output tray configured to receive the refrigerant leaving the first portion of the radiator.

16. A cooling system according to claim 10 wherein:

the first portion of the radiator has at least a "U" shape;

the first tray of the first portion is an input tray configured to receive the refrigerant directed toward the first portion of the radiator; and the third tray of the first portion is an intermediate tray.

17. A cooling system according to claim 10 wherein:

the second portion of the radiator has a rectilinear shape;

the second tray of the second portion is an input tray configured to receive the refrigerant directed toward the second portion of the radiator; and the fourth tray of the second portion is an output tray configured to receive the refrigerant leaving the second portion of the radiator.

18. A cooling system according to claim 10 wherein the electrical components comprise an electric machine, a power electronic converter configured to drive the electric machine, and a system configured to store electrical energy, the system connected to the power electronic converter.

* * * * *